US009617855B2

(12) United States Patent
Chang et al.

(10) Patent No.: US 9,617,855 B2
(45) Date of Patent: Apr. 11, 2017

(54) REACTION-TYPE TURBINE

(71) Applicants: Young Il Chang, Ansan-si (KR); Ki Tae Kim, Yongin-si (KR); Yong Sik Hah, Seoul (KR); Jung Hoon Kim, Yongin-si (KR)

(72) Inventors: Young Il Chang, Ansan-si (KR); Ki Tae Kim, Yongin-si (KR); Yong Sik Hah, Seoul (KR); Jung Hoon Kim, Yongin-si (KR)

(73) Assignee: HK TURBINE CO., LTD., Gyeonggi-do, Anyang-si (KR)

( * ) Notice: Subject to any disclaimer, the term of this patent is extended or adjusted under 35 U.S.C. 154(b) by 476 days.

(21) Appl. No.: 14/352,701

(22) PCT Filed: Oct. 12, 2012

(86) PCT No.: PCT/KR2012/008270

§ 371 (c)(1),
(2) Date: Apr. 18, 2014

(87) PCT Pub. No.: WO2013/058500

PCT Pub. Date: Apr. 25, 2013

(65) Prior Publication Data

US 2014/0255154 A1 Sep. 11, 2014

(30) Foreign Application Priority Data

Oct. 18, 2011 (KR) ..... 10-2011-0106434
May 11, 2012 (KR) ..... 10-2012-0050078

(51) Int. Cl.
*F01D 5/06* (2006.01)
*F01D 25/16* (2006.01)
(Continued)

(52) U.S. Cl.
CPC ..... *F01D 5/06* (2013.01); *F01D 1/32* (2013.01); *F01D 1/34* (2013.01); *F01D 25/16* (2013.01); *F05D 2240/242* (2013.01)

(58) Field of Classification Search
CPC ..... F01D 5/06; F01D 1/32; F01D 1/34; F01D 25/16; F05D 2240/242
(Continued)

(56) References Cited

U.S. PATENT DOCUMENTS 1,593,414 A * 7/1926 Kraft ..... F01D 3/02 415/173.7
1,681,607 A * 8/1928 Bowen ..... F01D 1/026 415/80
(Continued)

FOREIGN PATENT DOCUMENTS

AU WO 9612872 A1 * 5/1996 ..... F01D 1/32
JP 2004-132208 A 4/2004
(Continued)

OTHER PUBLICATIONS

International Search Report for PCT/KR2012/008270 mailed Feb. 25, 2013 from Korean Intellectual Property Office.

*Primary Examiner* — Nicholas J Weiss
*Assistant Examiner* — Jason T Newton
(74) *Attorney, Agent, or Firm* — Paratus Law Group, PLLC

(57) ABSTRACT

A reaction-type turbine according to the present invention is configured in that a portion of a rotary shaft module which penetrates through a side with an inlet portion of a housing has a diameter larger than the diameters of other portions. Thus, the pressurized area in which a working fluid applies pressure to a rotary shaft in the direction opposite to the working fluid flow direction increases, thus increasing force in the direction opposite to the working fluid flow direction. As a result, axial direction force applied to the rotary shaft
(Continued)

in the working fluid flow direction may be reduced. Therefore, the reaction-type turbine of the present invention has the advantages of eliminating the necessity of installing a separate thrust bearing for supporting axial force in the working fluid flow direction.

15 Claims, 4 Drawing Sheets

(51) Int. Cl.
*F01D 1/32* (2006.01)
*F01D 1/34* (2006.01)

(58) Field of Classification Search
USPC ..... 415/80, 77, 199.1, 199.6
See application file for complete search history.

(56) References Cited

U.S. PATENT DOCUMENTS

| | | | | |
|---|---|---|---|---|
| 4,082,477 | A | 4/1978 | Kronogard | |
| 2012/0312274 | A1* | 12/2012 | Bubbico | F01D 1/32<br>123/200 |

FOREIGN PATENT DOCUMENTS

| | | | |
|---|---|---|---|
| KR | 10-2008-0105054 | A | 12/2008 |
| KR | 10-1052253 | B1 | 4/2009 |
| KR | 10-2009-0076158 | A | 7/2009 |

* cited by examiner

REACTION-TYPE TURBINE

CROSS REFERENCE TO PRIOR APPLICATIONS

This application is a National Stage Patent Application of PCT International Patent Application No. PCT/KR2012/008270 (filed on Oct. 12, 2012) under 35 U.S.C. §371, which claims priority to Korean Patent Application Nos. 10-2011-0106434 (filed on Oct. 18, 2011) and 10-2012-0050078 (filed on May 11, 2012), which are all hereby incorporated by reference in their entirety.

TECHNICAL FIELD

The present invention relates to a reaction-type turbine, and more particularly, to a reaction-type turbine that generates rotational force using repulsive force when a working fluid, such as steam, gas or compressed air, is jetted.

BACKGROUND ART

In general, a steam turbine is a motor type in which thermal energy of steam is converted into a mechanical work. The steam turbine has less vibration, good efficiency, high speed and large horsepower and thus is widely used for thermal power generation or a main engine of a ship. In the steam turbine, high-temperature high-pressure steam generated in a boiler collides with a turbine wing that rotates high-speed steams of vapours that are spouted and expanded from nozzles or fixed wings, and a rotary shaft is rotated by an impulse action or a rebound action. Thus, the steam turbine is configured of nozzles that convert thermal energy of steam into speed energy and the turbine wing that converts speed energy into a mechanical work. The steam turbine includes an impulse type turbine that drives the turbine wing using only impulse force and a rebound type turbine or reaction-type turbine that drives the turbine wing using rebound force.

Korean Patent Registration No. 10-1052253 (published on Apr. 15, 2009) discloses a reaction-type turbine. In the reaction-type turbine, unlike a conventional turbine, a working fluid is jetted from jet rotation portions to the outside, and a turbine shaft is rotated by repulsive force thereof. In the reaction-type turbine, pressure of an inlet side of a housing is high, and pressure of an outlet side of the housing is relatively low. Thus, axial direction force is applied in a direction from the inlet side to the outlet side such that a thrust bearing supporting an axial load of a rotary shaft may be easily damaged.

DETAILED DESCRIPTION OF THE INVENTION

Technical Problem

The present invention provides a reaction-type turbine that is capable of reducing axial force applied to a thrust bearing.

Technical Solution

According to an aspect of the present invention, there is provided a reaction-type turbine including: a housing which includes an inlet portion of the housing and an outlet portion of the housing and in which a housing flow path that communicates the inlet portion of the housing and the outlet portion of the housing so that a high-pressure working fluid introduced into the inlet portion of the housing is capable of being moved in a direction of the outlet portion of the housing; a rotary shaft module which includes a rotary shaft that penetrates through the housing and is rotatably coupled to the housing and in which a portion of the rotary shaft that penetrates through a side with the inlet portion of the housing has a diameter larger than a diameter of a portion of the rotary shaft that penetrates through a side with the outlet portion of the housing; and a rotor that is integrally coupled to the rotary shaft within the housing flow path and rotates the rotary shaft as the working fluid introduced from a center side of the rotor in an axial direction is jetted to an outer circumferential side of the rotor.

According to another aspect of the present invention, there is provided a reaction-type turbine including: a housing which includes an inlet portion of the housing and an outlet portion of the housing and in which a housing flow path that communicates the inlet portion of the housing and the outlet portion of the housing so that a high-pressure working fluid introduced into the inlet portion of the housing is capable of being moved in a direction of the outlet portion of the housing; a rotary shaft module which includes a rotary shaft that penetrates through the housing and is rotatably coupled to the housing and a rotary shaft enlargement member that is coupled to a portion of the rotary shaft which penetrates through the inlet portion of the housing and that increases a pressurized area of the working fluid so that axial direction force applied to the rotary shaft increases in a direction opposite to a working fluid flow direction; and a rotor that is integrally coupled to the rotary shaft within the housing flow path and rotates the rotary shaft as the working fluid introduced from a center side of the rotor in an axial direction is jetted to an outer circumferential side of the rotor.

Effect of the Invention

In a reaction-type turbine according to the present invention, a portion of a rotary shaft module which penetrates through a side with an inlet portion of a housing has a diameter larger than the diameters of other portions. Thus, the pressurized area in which a working fluid applies pressure to a rotary shaft in the direction opposite to the working fluid flow direction increases, thus increasing force in the direction opposite to the working fluid flow direction. As a result, axial direction force applied to the rotary shaft in the working fluid flow direction may be reduced. Therefore, the reaction-type turbine of the present invention has the advantages of eliminating the necessity of installing a separate thrust bearing for supporting axial direction force in the working fluid flow direction.

In addition, the reaction-type turbine further includes a rotary shaft enlargement member that is disposed between the inlet portion of the housing and a rotor and that will be coupled to the rotary shaft, and the rotary shaft enlargement member is separately manufactured to have a larger diameter than that of the rotary shaft and is coupled to the rotary shaft so that a processing time or cost for enlarging the diameter of the rotary shaft can be reduced.

Furthermore, the rotary shaft enlargement member is screw-coupled to the rotary shaft, and a direction in which the rotary shaft enlargement member is screw-coupled to the rotary shaft, is set to be opposite to a rotation direction of the rotary shaft so that the rotary shaft enlargement member can be solidly coupled to the rotary shaft.

MODE OF THE INVENTION

Hereinafter, a reaction-type turbine according to the present invention will be described with reference to the attached drawings in detail.

Figure 1:
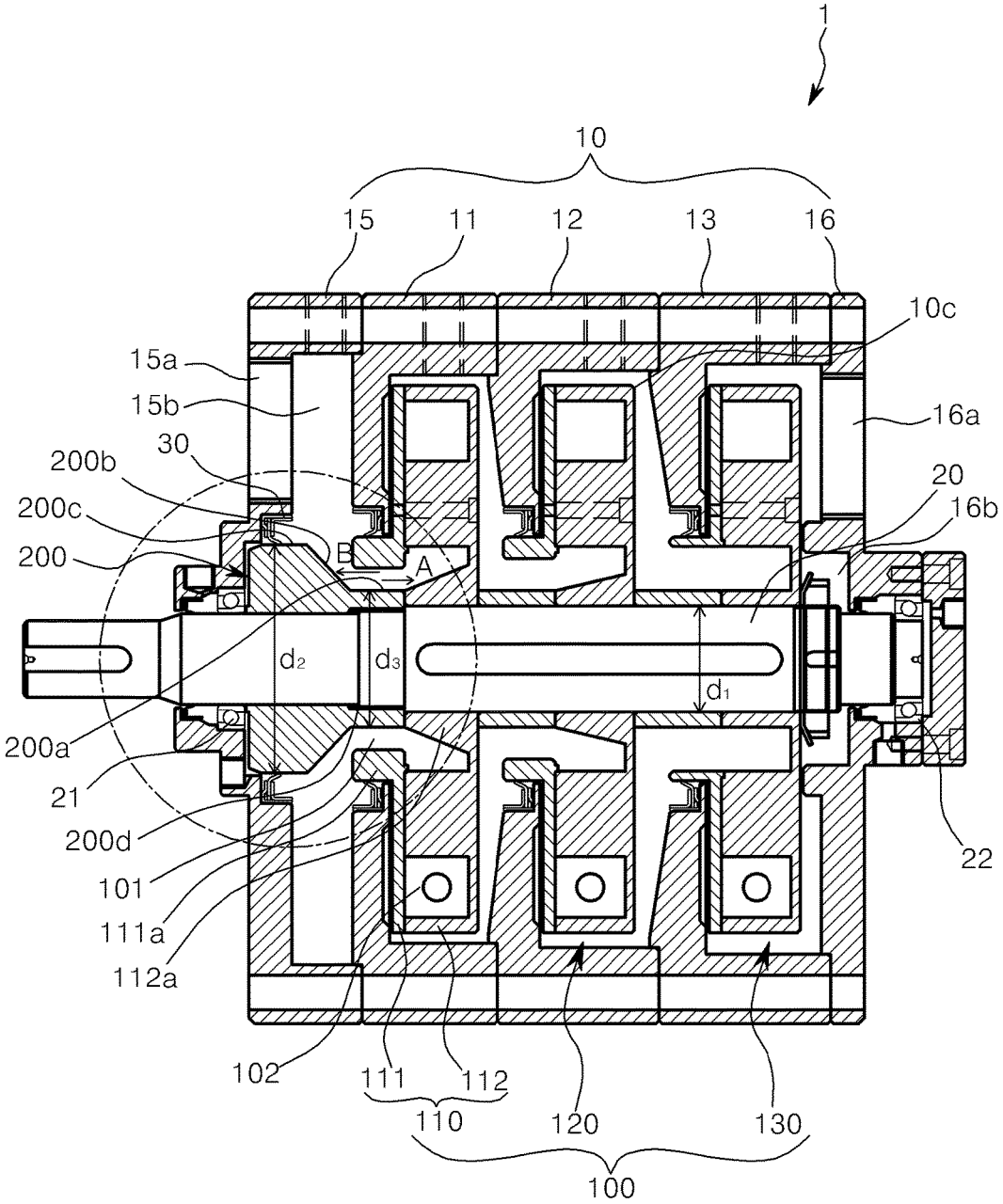
FIG. 1 is a cross-sectional view illustrating a reaction-type turbine according to a first embodiment of the present invention.
Figure 2:
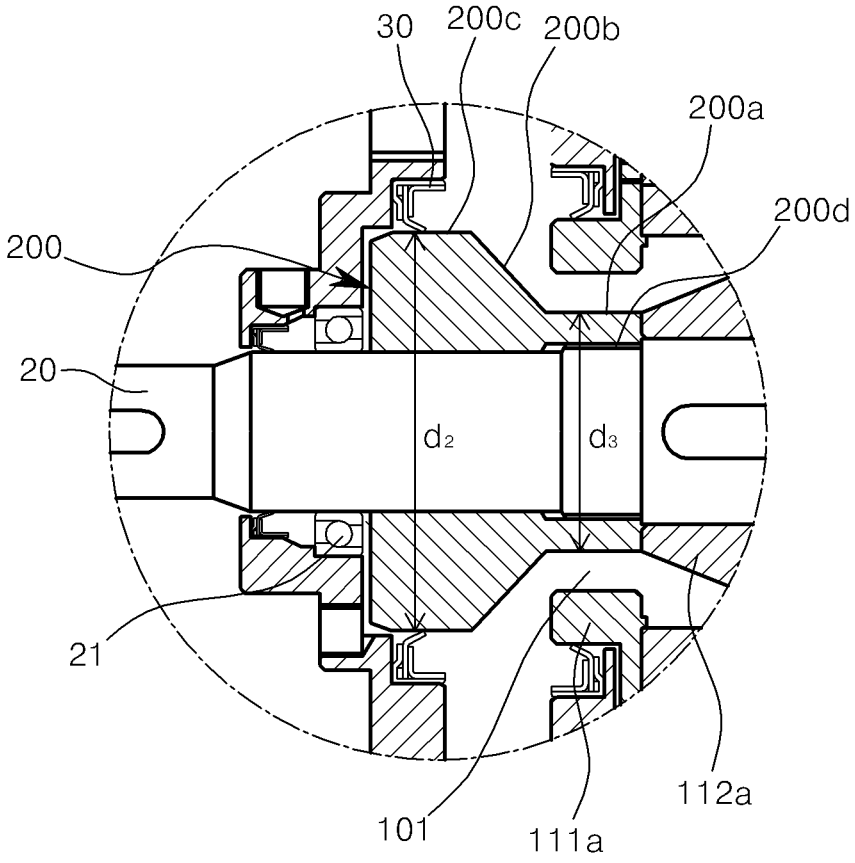
FIG. 2 is an enlarged view of a portion of FIG. 3.

Referring to FIGS. 1 and 2, a reaction-type turbine 1 according to a first embodiment of the present invention generates rotational force using a working fluid including high-pressure steam, gas or compressed air. The working fluid includes high-pressure steam, gas or compressed air. Hereinafter, in the current embodiment, an example in which the working fluid is steam, will be described.

The reaction-type turbine 1 includes a housing 10, a rotary shaft module including a rotary shaft 20, and a rotor 100. The housing 10 includes an inlet side housing 15 including a housing inlet 15*a* through which high-pressure steam as a working fluid is introduced and an inlet portion 15*b* of the housing 10 through which introduced steam passes, an outlet side housing 16 that is disposed at the other side of the inlet side housing 15 at predetermined intervals and includes a housing outlet 16*a* and an outlet portion 16*b* of the housing 10 through which expanded low-pressure steam is discharged in the air or is discharged for re-circulation, and intermediate housings 11, 12, and 13 that are provided between the inlet side housing 15 and the outlet side housing 16 and constitute a housing flow path 10*c* so that the rotor 100 can rotate. At least one housing inlet 15*a* may be provided, and in the current embodiment, an example in which one housing inlet 15*a* is formed, will be described. At least one housing outlet 16*a* may be provided, and in the current embodiment, an example in which one housing outlet 16*a* is formed, will be described. The number of intermediate housings 11, 12, and 13 that corresponds to the number of rotors 100 may be provided. In the current embodiment, an example in which three rotors 100 that will be described later are provided, will be described. Thus, an example in which three intermediate housings 11, 12, and 13 are provided along an axial direction, will be described.

The rotor 100 is coupled integrally with the rotary shaft 20 and rotates the rotary shaft 20 as steam introduced from a center side in the axial direction is jetted from an outer circumferential side of the rotor 100 in a circumferential direction of the rotor 100. Speed and performance of the turbine may vary according to the number of rotors 100 coupled to the rotary shaft 20. That is, when a pressure difference in both ends of the turbine is small or the turbine need to rotate at high speed, a small number of rotors 100 may be configured, and when the pressure difference in both ends of the turbine is large or the turbine need to rotate at low speed, a large number of rotors 100 may be configured.

A plurality of rotors 100 are disposed within the housing flow path 10*c* along the axial direction and are stacked in multiple stages, and steam jetted from a front rotor to the outer circumferential side of the rotor 100 is introduced into a center side of a rear rotor via the housing flow path 10*c*. In the current embodiment, an example in which the rotor 100 is configured of three (first-stage, second-stage, and third-stage) rotors 110, 120, and 130, will be described. The three (first-stage, second-stage, and third-stage) rotors 110, 120, and 130 are disposed along the axial direction. An example in which each of the three (first-stage, second-stage, and third-stage) rotors 110, 120, and 130 includes a rotor plate 112 that constitutes an internal flow path 102 through which steam passes and a rotor cover 111 that is coupled to one side of the rotor plate 112, will be described. However, embodiments of the present invention are not limited thereto, and the rotor 100 may include two rotor plates. A plate boss portion 112*a* which has a disc shape and into which the rotary shaft 20 is inserted, is formed in the center of the rotor plate 112. An inlet portion 101 of the rotor 100 is formed at an outer circumferential surface of the plate boss portion 112*a* and introduces the steam in the axial direction and transfers the steam to the internal flow path 102.

The internal flow path 102 is a kind of groove that is formed in one surface of the rotor plate 112 and guides the steam introduced from an inlet portion 101 of the rotor 100 in the axial direction to an outer circumferential side of the rotor plate 112. A plurality of internal flow paths 102 may be formed. At least one internal flow path 102 may be formed, and a different number of internal flow paths may be formed in each of the three (first-stage, second-stage, and third-stage) rotors 110, 120, and 130. For example, the number of internal flow paths 102 may be increased from a front current to a rear current. A nozzle portion having a smaller cross-sectional area than that of a discharge portion side of the internal flow path 102 is installed at the discharge portion side of the internal flow path 102. However, embodiments of the present invention are not limited thereto, and separate nozzles each having a small diameter portion may be installed at the discharge portion side of the internal flow path 102 using a fastening member.

The rotor cover 111 has a disc shape, and a cover boss portion 111*a* that has a shape corresponding to the plate boss portion 112*a* is formed in the center of the rotor cover 111. The inlet portion 101 of the rotor 100 is configured by the plate boss portion 112*a* and the cover boss portion 111*a*. The rotor cover 111 covers the entire surface of the rotor plate 112 and is integrally fastened and fixed to the rotor plate 112 using a fastening member, such as a bolt. The entire surface of the internal flow path 102 having a groove shape may be shielded by the rotor cover 111.

The rotary shaft module includes the rotary shaft 20 and a rotary shaft enlargement member 200 coupled to the rotary shaft 20. The rotary shaft 20 is rotatably coupled to the housing 10.

The rotary shaft enlargement member 200 is inserted into an outer circumferential surface of a portion of the rotary shaft 20 which penetrates through the inlet portion 15*b* of the housing 10 and is coupled to the rotary shaft 20. The rotary shaft enlargement member 200 is integrally coupled to the rotary shaft 20 in the axial direction from the inlet portion 15*b* of the housing 10. That is, the rotary shaft enlargement member 200 is coupled to the rotary shaft 20 between the inlet side housing 15 and the first-stage rotor 110. Since, generally, pressure of the working fluid at the inlet portion 15*b* of the housing 10 is high and pressure at the outlet portion 16*b* of the housing 10 is low, an axial load, i.e., a thrust, is applied in a working fluid flow direction A. Meanwhile, the rotary shaft enlargement member 200 has a larger diameter than that of the rotary shaft 20 so that a pressurized area in which the working fluid applies pressure to the rotary shaft 20 in a direction B opposite to the working fluid flow direction A increases and axial direction force applied by the working fluid to the rotary shaft 20 in the direction B opposite to the working fluid flow direction A increases. Thus, the rotary shaft enlargement member 200 may reduce the thrust applied in the working fluid flow direction A.

The rotary shaft enlargement member 200 has one ring shape and is coupled to the rotary shaft 20 in the axial direction. The rotary shaft enlargement member 200 has an average diameter larger than the diameters of other portions of the rotary shaft 20. The average diameter of the rotary shaft enlargement member 200 is larger than a diameter of a portion of the rotary shaft 20 which penetrates through the outlet portion 16*b* of the housing 10 or diameters d1 of other portions. In the current embodiment, an example in which the average diameter of the rotary shaft enlargement member 200 is larger than the diameter d1 of a portion of the rotary shaft 20 which penetrates through the outlet portion 16*b* of the housing 10, will be described. Diameters of portions of the rotary shaft enlargement member 200 may be the same along the axial direction, or diameters of whole portions of the rotary shaft enlargement member 200 may be different from each other along the axial direction, or a diameter of a portion of the rotary shaft enlargement member 200 may be different from the diameters of other portions of the rotary shaft enlargement member 200. In the current embodiment, an example in which at least a portion of the rotary shaft enlargement member 200 has a diameter that increases in the direction B opposite to the working fluid flow direction A, will be described. That is, the rotary shaft enlargement member 200 includes a first enlargement portion 200*a* formed with a first diameter d3 that is larger than the diameter d1 of the rotary shaft 20, an inclination portion 200*b* that extends from the first enlargement portion 200*a* in a direction of the housing inlet 15*a* and has a diameter that increases gradually, and a second enlargement portion 200*c* that extends from the inclination portion 200*b* in a direction of the inlet portion 15*a* of the housing 10 and is formed with a second diameter d2 larger than the first diameter d3.

A screw coupling portion 200*d* that is screw-coupled to an outer circumferential surface of the rotary shaft 20, is formed on an inner circumferential surface of the rotary shaft enlargement member 200. The screw coupling portion 200*d* may be formed on the whole inner circumferential surface of the rotary shaft enlargement member 200 or on only a portion of the inner circumferential surface of the rotary shaft enlargement member 200. In the current embodiment, an example in which the screw coupling portion 200*d* is formed on an inner circumferential surface of the first enlargement portion 200*a*, will be described. A direction of a thread of the screw coupling portion 200*d* is set so that a direction in which the rotary shaft enlargement member 200 and the rotary shaft 20 are screw-coupled to each other, is a direction opposite to a direction in which the rotary shaft 20 rotates. A thread through which the screw coupling portion 200*d* is screw-coupled to the outer circumferential surface of the rotary shaft 20, is formed on the outer circumferential surface of the rotary shaft 20.

When the rotary shaft enlargement member 200 is coupled to the rotary shaft 20 in the axial direction, an end of the first enlargement portion 200*a* is hung in the plate boss portion 112*a* and thus, an axial coupling length of the rotary shaft enlargement member 200 is limited. That is, the plate boss portion 112*a* guides a coupling position of the rotary shaft enlargement member 200.

Meanwhile, bearings 21 and 22 that support the rotary shaft 20 are installed at one side or both sides of the housing 10. In the current embodiment, the first and second bearings 21 and 22 are installed at both sides of the housing 10. Angular contact ball bearings or spindle bearings that can support a portion of the axial load in addition to a radial load may be used as the first and second bearings 21 and 22. Since an axial thrust is reduced due to the rotary shaft enlargement member 200, the angular contact ball bearing that can support the radial load and a portion of the axial load, can be used without installing a separate thrust bearing. Thus, a structure may be compact. However, embodiments of the present invention are not limited thereto, and simple radial bearings may also be used as the first and second bearings 21 and 22.

A fourth sealing member 30 is provided between the second enlargement portion 200*c* of the rotary shaft enlargement member 200 and an inside of the housing 10 so as to prevent a leakage of the working fluid.

An operation of a reaction-type turbine having the above structure according to a first embodiment of the present invention will be described below.

If a high-pressure working fluid generated in a boiler is supplied to the housing inlet 15*a* of the housing 10 via a pipe, the working fluid is introduced into the first-stage rotor 110 via the inlet portion 15*b* of the housing 10. Hereinafter, an example in which steam is used as the working fluid, will be described.

The steam introduced in the axial direction via the inlet portion 101 of the rotor 10 of the first-stage rotor 110 is distributed into a plurality of internal flow paths 102. The distributed steam passes through the plurality of internal flow paths 102, is moved to the outer circumferential side of the first-stage rotor 110 and is jetted to the housing flow path 10*c* along the circumferential direction of the rotor 100 at high speed.

The steam jetted to the outer circumferential side of the first-stage rotor 110 is introduced into the center side of the second-stage rotor 120 disposed behind the first-stage rotor 110, and the steam introduced into the second-stage rotor 120 passes through internal flow paths of the second-stage rotor 120 and is jetted to an outer circumferential side of the second-stage rotor 120. The steam jetted to the outer circumferential side of the second-stage rotor 120 is introduced into the center side of the third-stage rotor 130, passes through internal flow paths of the third-stage rotor 130 and then is jetted to an outer circumferential side of the third-stage rotor 130. The steam jetted to the outer circumferential side of the third-stage rotor 130 is discharged to an outside of the housing 10 via the housing outlet 16*a*. A series of operations in which the steam discharged to the outside of the housing 10 is discharged in the air or is recovered by a condenser (not shown) and then is circulated to the boil, are repeatedly performed.

The first-stage, second-stage, and third-stage rotors 110, 120, and 130 rotate by a reaction generated when the high-pressure steam is jetted in circumferential directions of the first-stage, second-stage, and third-stage rotors 110, 120, and 130. Rotational force generated in this case is transferred to the rotary shaft 20 to which the first-stage, second-stage, and third-stage rotors 110, 120, and 130 are coupled, and the rotational force is transferred to the outside when the rotary shaft 20 rotates together with the first-stage, second-stage, and third-stage rotors 110, 120, and 130.

As described above, while the working fluid is introduced via the housing inlet 15*a* and is discharged through the housing outlet 16*a*, pressure is reduced in the working fluid flow direction A. That is, pressure of the working fluid at the first-stage rotor 110 is high, and pressure at the third-stage rotor 130 is low. Thus, a thrust is generally applied in the working fluid flow direction A but the rotary shaft enlargement member 200 is installed between the first-stage rotor 110 and the inlet portion 15*b* of the housing 10, the high-pressure working fluid pressurizes the rotary shaft enlargement member 200 in the direction B opposite to the working fluid flow direction A so that the thrust in the working fluid flow direction A can be reduced. Thus, a thrust bearing for supporting the thrust in the working fluid flow direction A need not to be installed. Also, the rotary shaft enlargement member 200 is formed to have the inclination portion 200*b* so that the working fluid in the inlet portion 15*b* of the housing 10 can be smoothly introduced into the inlet portion 101 of the first-stage rotor 110.

Figure 3:
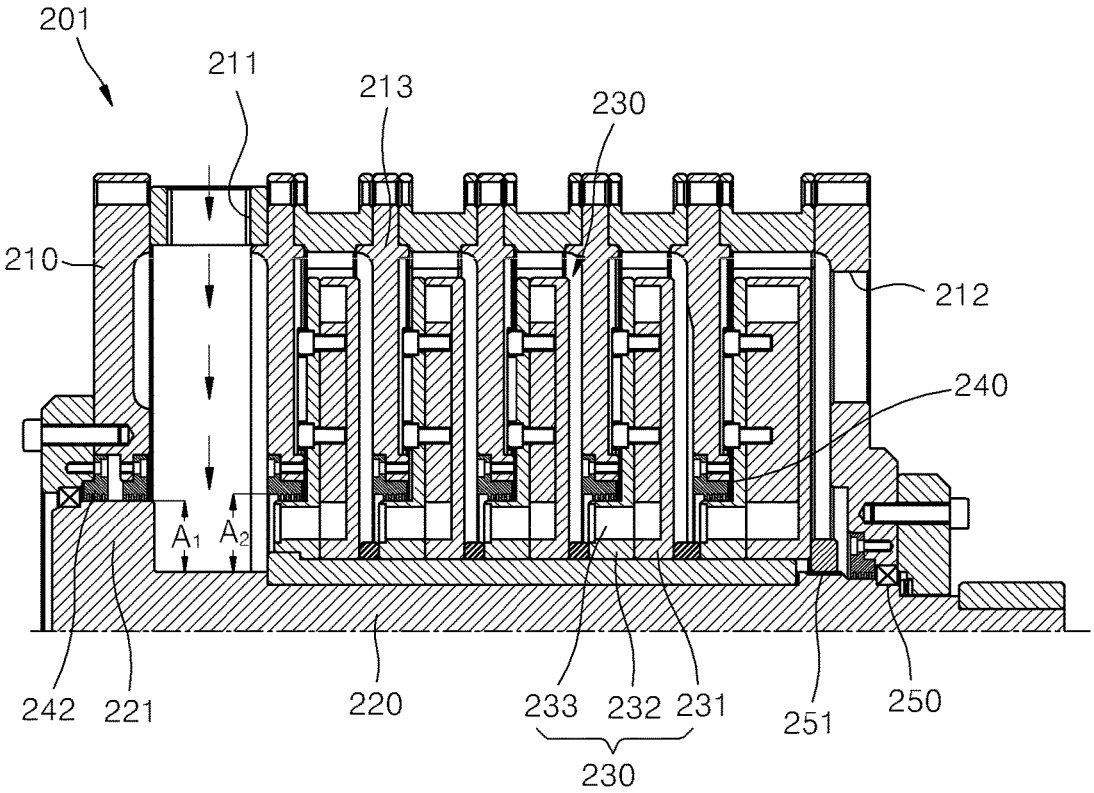
FIG. 3 is a cross-sectional view illustrating a reaction-type turbine according to a second embodiment of the present invention.

Referring to FIG. 3, a reaction-type turbine 210 according to a second embodiment of the present invention includes a housing 210, a rotary shaft module including a rotary shaft 220, and a rotor 230.

An internal space is formed in the housing 210. An inlet portion 211 of the housing 210 opened through which the working fluid is introduced, is formed at one side of the housing 210. An outlet portion 212 of the housing 210 through which the working fluid is discharge, is formed at the other side of the housing 210. The housing 210 is formed to accommodate at least a portion of the rotor 230. A plurality of unit spaces are formed in the housing 210. One rotor 230 is accommodated in one unit space. The plurality of unit spaces of the housing 210 are formed by a plurality of partition walls 213. The plurality of partition walls 213 are disposed within the housing 210 to be spaced apart from each other by a predetermined gap.

The rotary shaft 220 has a cylindrical shape with a particular diameter and is disposed to penetrate through the housing 210. The rotary housing 220 is rotatably coupled to the housing 210. When the reaction-type turbine 201 is applied to a generator, an electromagnet included in the generator may be coupled to the rotary shaft 220 so that electricity can be produced. Also, when the reaction-type turbine 201 is applied to a power plant, a belt or gear may also be coupled to the rotary shaft 220. A bearing 150 is installed at a portion where the rotary shaft 220 and the housing 210 contact each other.

A portion of the rotary shaft 220 which penetrates through a side with the inlet portion 211 of the housing 210, has a diameter larger than a diameter of a portion of the rotary shaft 220 which penetrates through a side with the outlet portion 212 of the housing 210. That is, an example in which a protrusion 221 is formed at the portion of the rotary shaft 220 which penetrates through the side with the inlet portion 211 of the housing 210, will be described. The protrusion 221 protrudes from at least a portion of a circumferential surface of the rotary shaft 220 to a predetermined thickness.

A thrust bearing 251 is disposed at at least a portion of the circumferential surface of the rotary shaft 220, preferably, at a portion where the rotor 230 and the housing 210 contact each other. The thrust bearing 251 causes rotation of the rotor 230 with respect to the housing 210 to be smoothly performed while the rotor 230 and the rotary shaft 220 rotate simultaneously.

As the rotor 230 is coupled to the rotary shaft 220 and the working fluid is jetted from a circumferential direction of the rotor 230, the rotor 230 rotates the rotary shaft 220. The rotor 230 includes a rotor cover 232 having an inlet portion 233 of the rotor 230 through which the working fluid is introduced in the axial direction, and a rotor plate 231 that jets the working fluid introduced into the rotor cover 232 from an outer circumferential side of the rotor 230 in the circumferential direction of the rotor 230. The rotor plate 231 jets the working fluid in the circumferential direction. The rotor plate 231 has a shape of a plate with a predetermined thickness. A flow path on which the working fluid moves, is formed in the rotor plate 231. In the current embodiment, an example in which the rotor plate 231 and the rotor cover 232 are separate elements, will be described. However, the rotor plate 231 and the rotor cover 232 may also be integrally formed.

A first sealing member 242 is installed between a side with the inlet portion 211 of the housing 210 and the rotary shaft 220 which penetrates through the side. The first sealing member 242 prevents the working fluid from being lost between the housing 210 and the rotary shaft 220.

A sealing portion that prevents a leakage of the working fluid is formed between an outside of the inlet portion 233 of the rotor 230 of the rotor cover 232 and the housing 210. An example in which the sealing portion is a third sealing member 240, will be described. The third sealing member 240 is disposed between a free end of the barrier walls 213 and the outside of the inlet portion 233 of the rotor 230. The third sealing member 240 prevents the working fluid from being lost and causes the working fluid to be stably introduced into the adjacent rotor 230.

Meanwhile, a cross-sectional area A1 of the rotary shaft 220 that penetrates through the side with the inlet portion 211 of the housing 210 is set to be between 80% and 100% of an internal cross-sectional area A2 of the third sealing member 240. Since the cross-sectional area A1 of the rotary shaft 220 that penetrates through the side with the inlet portion 211 of the housing 210 is equal to or less than the internal cross-sectional area A2 of the third sealing member 240, slight axial force applied to the rotary shaft 220 when the reaction-type turbine 201 operates, is applied in the working fluid flow direction so that a stable operation of the reaction-type turbine 201 can be performed.

An operation of the reaction-type turbine having the above structure according to the second embodiment of the present invention will be described below.

When the reaction-type turbine 201 operates, the working fluid is introduced into the inlet portion 211 of the housing 210. The working fluid introduced into the inlet portion 211 of the housing 210 contacts the protrusion 221 and applies force in a left direction that is opposite to the working fluid flow direction and simultaneously, contacts one surface of the rotor cover 232 and applies force in a right direction that is the working fluid flow direction. When the fluid is jetted onto one surface of a particular member, force applied to the particular member is proportional to an area that contacts the fluid. Since the working fluid contacts the protrusion 221 and applies force in a direction opposite to the working fluid flow direction, force applied to the rotary shaft 220 in the left direction by the protrusion 221 may increase, and axial force applied to the rotary shaft 220 in the right direction may be reduced. Thus, since force applied to the thrust bearing 251 is reduced, damage of the thrust bearing 251 can be prevented.

Figure 4:
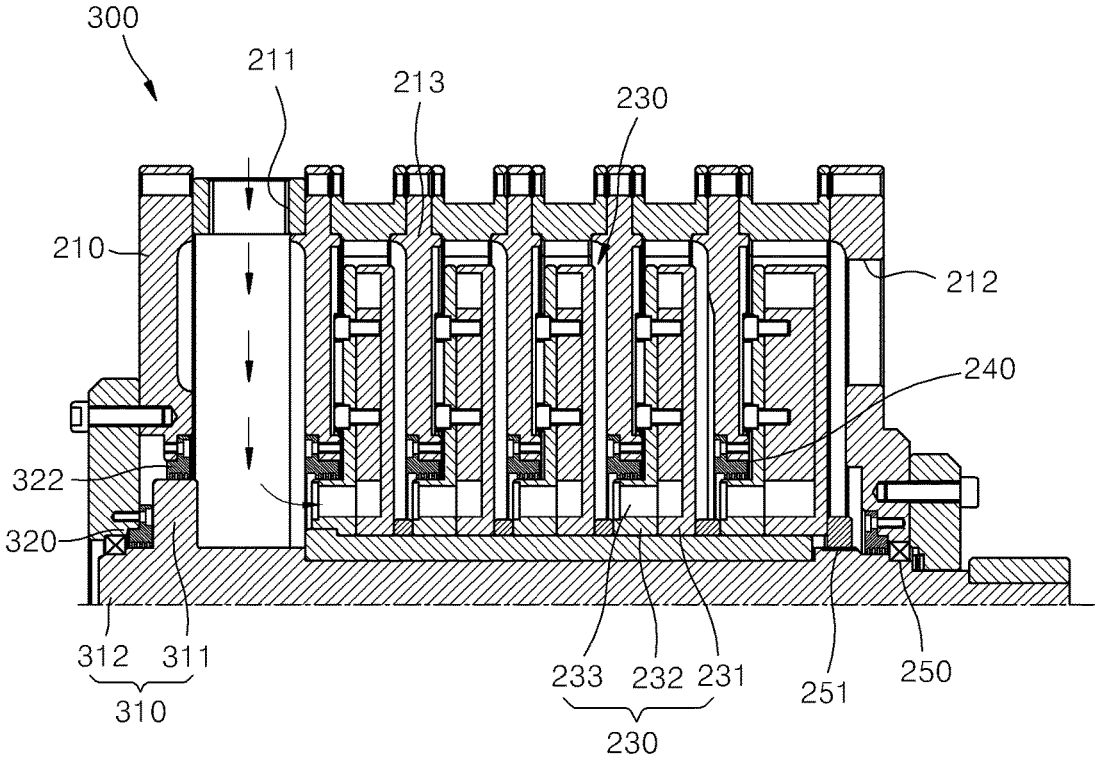
FIG. 4 is a cross-sectional view illustrating a reaction-type turbine according to a third embodiment of the present invention.

Meanwhile, referring to FIG. 4, a reaction-type turbine 300 according to a third embodiment of the present invention is different from the reaction-type turbine 201 according to the second embodiment in that a rotary shaft 310 includes a protrusion 311 and a small diameter portion 312 that are placed at a portion that penetrates through the side with the inlet portion 211 of the housing 210, and differences therebetween will be described in detail.

A diameter of the protrusion 311 is larger than diameters of other portions of the rotary shaft 310, and the small diameter portion 312 is formed to have a smaller diameter than that of the protrusion 311.

A second sealing member 320 is installed between the small diameter portion 312 and the housing 210, and a first sealing member 322 is installed between the protrusion 311 and the housing 210. The first and second sealing members 322 and 320 prevent the working fluid from being lost to the outside.

In the reaction-type turbine 300 having the above structure according to the third embodiment of the present invention, the small diameter portion 312 is formed on the rotary shaft 310 so that the size of the second sealing member 320 can be reduced compared to the case that no small diameter portion 312 is formed on the rotary shaft 310. Thus, since a contact area between the rotary shaft 310 and the housing 210 is reduced, the working fluid can be prevented from leaking.

While the present invention has been particularly shown and described with reference to exemplary embodiments thereof, it will be understood by those of ordinary skill in the art that various changes in form and details may be made therein without departing from the spirit and scope of the present invention as defined by the following claims.

INDUSTRIAL APPLICABILITY

According to the present invention, a reaction-type turbine in which the necessity of installing a separate thrust bearing for supporting axial direction force in the working fluid flow direction is eliminated, can be manufactured.

The invention claimed is:

1. A reaction-type turbine comprising:

a housing which comprises an inlet portion of the housing and an outlet portion of the housing and in which a housing flow path that communicates the inlet portion of the housing and the outlet portion of the housing so that a working fluid introduced into the inlet portion of the housing is capable of being moved in a direction of the outlet portion of the housing;

a rotary shaft assembly which comprises a rotary shaft that penetrates through the housing and is rotatably coupled to the housing and in which a portion of the rotary shaft that penetrates through a side with the inlet portion of the housing has a diameter larger than a diameter of a portion of the rotary shaft that penetrates through a side with the outlet portion of the housing; and a rotor that is integrally coupled to the rotary shaft within the housing flow path and rotates the rotary shaft as the working fluid introduced from a center side of the rotor in an axial direction is jetted to an outer circumferential side of the rotor, wherein the rotary shaft assembly comprises a rotary shaft enlargement member that is coupled to a portion of the rotary shaft which penetrates through the inlet portion of the housing and that has an average diameter larger than that of the rotary shaft.

2. The reaction-type turbine of claim 1, wherein the rotary shaft enlargement member is inserted into an outer circumferential surface of a portion of the rotary shaft and is coupled to the rotary shaft.

3. The reaction-type turbine of claim 1, wherein the rotary shaft enlargement member has a ring shape and is coupled to the rotary shaft in an axial direction.

4. The reaction-type turbine of claim 1, wherein the rotary shaft enlargement member is screw-coupled to the rotary shaft.

5. The reaction-type turbine of claim 4, wherein a direction in which the rotary shaft enlargement member and the rotary shaft are screw-coupled, is set to be opposite to a rotation direction of the rotary shaft.

6. The reaction-type turbine of claim 1, wherein a diameter of the rotary shaft enlargement member increases as the rotary shaft enlargement member gets far away from the outlet portion of the housing.

7. The reaction-type turbine of claim 1, wherein an inlet portion of a rotor through which the working fluid is introduced in the axial direction, is formed at the rotor, and a portion of an outer circumferential surface of the rotary shaft enlargement member is formed to be inclined toward the inlet portion of the rotor so as to guide the working fluid introduced from the inlet portion of the housing to the inlet portion of the rotor.

8. The reaction-type turbine of claim 1, wherein the housing comprises an inlet side housing including a housing inlet through which the working fluid is introduced, an outlet side housing that is disposed at the other side of the inlet side housing at predetermined intervals and includes a housing outlet through which the working fluid is discharged, and intermediate housings that are provided between the inlet side housing and the outlet side housing and constitute a housing flow path through which the working fluid passes, and the rotary enlargement member is coupled to the rotary shaft between the inlet side housing and the rotor.

9. The reaction-type turbine of claim 1, further comprising bearings that are installed at one side or both sides of the housing and supports the rotary shaft, wherein the bearings are angular contact ball bearings.

10. The reaction-type turbine of claim 1, wherein a plurality of rotors are disposed within the housing flow path and are stacked in multiple stages along the axial direction, and the working fluid jetted from a front rotor to the outer circumferential side of the rotor is introduced to a center side of a rear rotor via the housing flow path.

11. The reaction-type turbine of claim 1, wherein a first sealing member is provided between the housing and a portion of the rotary shaft that penetrates through the side with the inlet portion of the housing.

12. The reaction-type turbine of claim 11, wherein a small diameter portion is formed at a portion of the rotary shaft that penetrates through the side with the inlet portion of the housing, and a second sealing member is provided between the small diameter portion and the housing.

13. The reaction-type turbine of claim 1, wherein an inlet portion of a rotor through which the working fluid is introduced in the axial direction, is formed at the rotor, and a sealing member is provided between the inlet portion of the rotor and the housing.

14. The reaction-type turbine of claim 13, wherein a cross-sectional area of the portion of the rotary shaft that penetrates through the side with the inlet portion of the housing is between 80% and 100% of an internal cross-sectional area of the third sealing member.

15. A reaction-type turbine comprising:

a housing which comprises an inlet portion of the housing and an outlet portion of the housing and in which a housing flow path that communicates the inlet portion of the housing and the outlet portion of the housing so that a working fluid introduced into the inlet portion of the housing is capable of being moved in a direction of the outlet portion of the housing;

a rotary shaft assembly which comprises a rotary shaft that penetrates through the housing and is rotatably coupled to the housing and a rotary shaft enlargement member that is coupled to a portion of the rotary shaft which penetrates through the inlet portion of the housing and that increases a pressurized area of the working fluid so that axial direction force applied to the rotary shaft increases in a direction opposite to a working fluid flow direction; and a rotor that is integrally coupled to the rotary shaft within the housing flow path and rotates the rotary shaft as the working fluid introduced from a center side of the rotor in an axial direction is jetted to an outer circumferential side of the rotor.

* * * * *